United States Patent [19]

Uchida

[11] Patent Number: 4,650,062

[45] Date of Patent: Mar. 17, 1987

[54] BOBBIN TRANSFER SYSTEM

[75] Inventor: Hiroshi Uchida, Oumihachiman, Japan

[73] Assignee: Murata Kikai Kabushiki Kaisha, Kyoto, Japan

[21] Appl. No.: 635,010

[22] Filed: Jul. 27, 1984

[30] Foreign Application Priority Data

Jul. 30, 1983 [JP] Japan ..... 58-140202

[51] Int. Cl.[4] ..... B65G 37/00

[52] U.S. Cl. ..... 198/468.2; 198/468.6

[58] Field of Search ..... 198/472, 486, 651, 696, 198/695, 653, 409, 436, 448, 465.1, 468.2, 803.01, 803.12, 482.1, 468.6; 414/225, 226, 744 A, 908, 910; 242/35.5 A; 57/281

[56] References Cited

U.S. PATENT DOCUMENTS 3,024,887 3/1962 Ingham, Jr. ..... 198/651 X
3,698,536 10/1972 Pray et al. ..... 198/651 X
4,036,353 7/1977 Suter ..... 198/696 X
4,274,532 6/1981 Johnson ..... 198/651 X
4,403,471 9/1983 Oswald ..... 198/468.2 X

FOREIGN PATENT DOCUMENTS 54-24587 3/1979 Japan ..... 198/409

*Primary Examiner*—Joseph E. Valenza
*Assistant Examiner*—D. Glenn Dayoan
*Attorney, Agent, or Firm*—Spensley Horn Jubas & Lubitz

[57] ABSTRACT

A bobbin transfer mechanism which is capable of gripping and transferring bobbins is provided between a bobbin transfer path on the side of a fine spinning frame and a bobbin transfer path on the side of a winder to transfer bobbins from one transfer path to the other. The bobbin transfer mechanism includes a guide shaft, a lift member slidably mounted on the guide shaft and being provided with a bobbin chuck device and a guide mechanism for the bobbin chuck device.

5 Claims, 12 Drawing Figures

BOBBIN TRANSFER SYSTEM

BACKGROUND OF THE INVENTION

1. Field of the Invention

This invention relates to a bobbin transfer system, and more particularly to a bobbin transfer system for transferring spinning bobbins or empty bobbins between a fine spinning frame and a winder.

2. Prior Art

For example, there has been known in the art a bobbin transfer mechanism, wherein spinning bobbins which are produced on a fine spinning frame, especially, on a ring frame are transferred to a winder one after another, for instance, by fitting the bobbins on pegs on a transport band which is moving in a longitudinal direction on the front side of the fine spinning frame, dropping the bobbins into a bobbin feed chute from a tilted upper end portion of the transport band.

In this sort of transfer mechanism, the free gravitational dropping motions of individual bobbins form an integral part of the transfer path. Namely, the transfer mechanism includes a guide chute serving as a passage which permits free dropping motions of bobbins, sliding bobbins on and along a guide surface of the chute. This causes troubles such as abrasion of surfaces of yarn layers, damages of yarn layers and pull-out of yarn ends by hitching same on other component parts.

Further, a mechanism in which, for delivery to the chute, the bobbins have to be once lifted up by tilting the transport band requires a space exclusively for handing over the bobbins, namely, a space to permit inclination of a conveyer or a space for inclination of the guide chute, giving rise to a problem of large transfer space in the case of a system where a fine spinning frame and a winder connected with each other.

SUMMARY OF THE INVENTION

An object of the present invention is to provide a transfer system employing a bobbin transfer mechanism of an extremely compact construction capable of gripping part of bobbins and transferring them one by one or group by group to a conveying means.

According to the present invention, a bobbin transfer mechanism which is capable of gripping and transferring bobbins is provided between a bobbin transfer path on the side of a fine spinning frame and a bobbin transfer path on the side of a winder to transfer bobbins from one transfer path to the other. Accordingly, there is no necessity for tilting the bobbin transfer path itself or for providing an intervening transfer path like a chute or the like. It follows that there is no need for securing spaces for a tilting conveyer and a chute, permitting to utilize the floor and working spaces effectively in a system in which a fine spinning frame and a winder are connected with each other. In addition, the chuck grips the take-up tube of a bobbin with yarn layers at the time of transfer, keeping other fixed or movable component parts off the surface of the yarn layers to prevent damages of yarns during the transfer operation.

Further, since the bobbins are restrained of free movements during transfer, it is possible to preclude irregular dropping motions of the bobbins and thus to transfer them in an extremely secure manner.

DETAILED DESCRIPTION OF THE INVENTION

Figure 2:
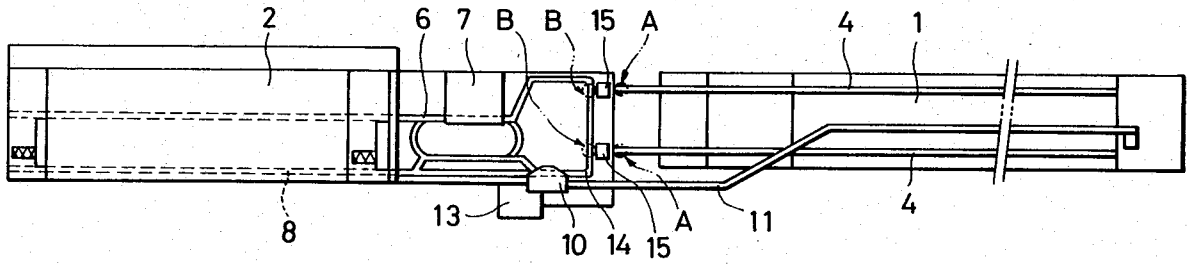
FIG. 2 is a plan view of the same spinning winder.

Hereafter, the invention is illustrated by way of preferred embodiments shown in the drawings.

Figure 1:
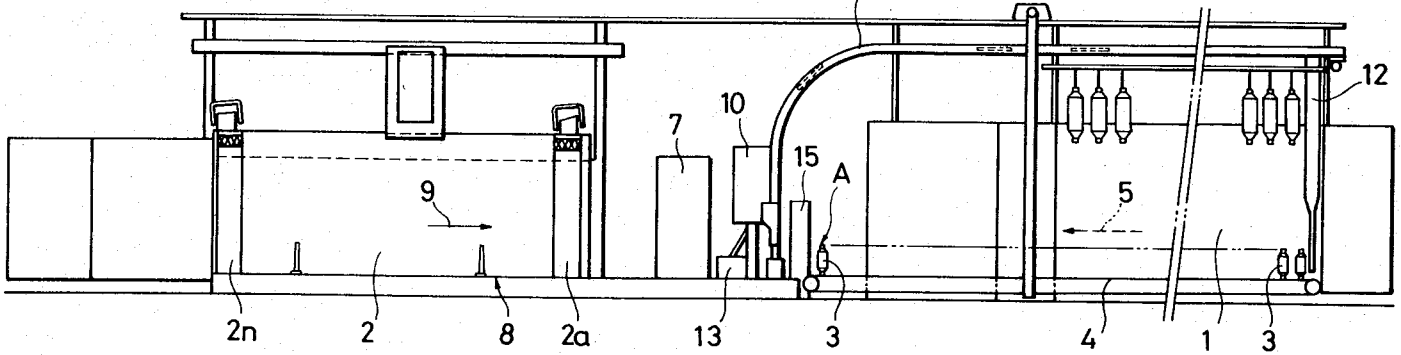
FIG. 1 is a layout of a fine spinning winder incorporating a first embodiment of the transfer system according to the present invention.

Referring to FIGS. 1 and 2, there is shown a layout of a fine spinning frame and a winder incorporating the system of the present invention. A fine spinning frame 1 and a winder 2 are connected by bobbin transfer paths which will be described hereinafter. Spinning bobbins 3 with spun yarns, which are produced by the spinning frame 1, are extracted and placed on a bobbin conveying means by a doffer of known construction, for example, they are fitted on pegs on a conveying means such as a transport band 4 running in the longitudinal direction of the spinning frame 1, transferring the bobbins in the direction of arrow 5 toward a bobbin delivering position A at a horizontal end of the transport band 4.

On the other hand, circulated through a transfer path of a closed loop, which is provided on the side of the winder 2, are carriers like peg trays carrying bobbins independently of each other on pegs formed at the centers of the respective disc-like bodies fed to and discharged from winding units. Namely, the carriers which have received a spinning bobbin at a bobbin receiving position B are passed through a readying device 7 on the transfer path 6 to find a yarn end and then fed further along the spinning bobbin transfer path 6 toward the respective winding units 2*a* to 2*n*. The empty bobbins or bobbins with residual yarn, resulting from the operations by the winding units, are transferred along a bobbin return path 8 in the direction of arrow 9 toward a bobbin sorter 10 to sort empty bobbins and bobbins with residual yarn or with an extremely small yarn residue. Namely, empty bobbins are extracted from the carriers and transferred along an empty bobbin transfer path 11 and dropped into a chute 12 at the end of the spinning frame 1 for insertion on empty pegs on a transport band 4 which stands by under the chute 12.

At the above-mentioned bobbin sorter 10, bobbins with an extremely small yarn residue unsuitable for the second time winding are drawn off the carriers and reserved in a bobbin box 13. The bobbins with a yarn residue of an amount which still permits winding are passed to the transfer path 14 to re-enter the readying device 7.

The empty carriers which have been get rid of an empty bobbin or small amount of yarn bobbin are advanced along the transfer path 14 toward the spinning bobbin receiving position to receive a fresh spinning bobbin.

Provided between the above-mentioned bobbin delivering and receiving positions is a bobbin transfer mechanism 15 which transfers the bobbins one by one from the transport band 4 onto carriers on the winder side.

Figure 3:
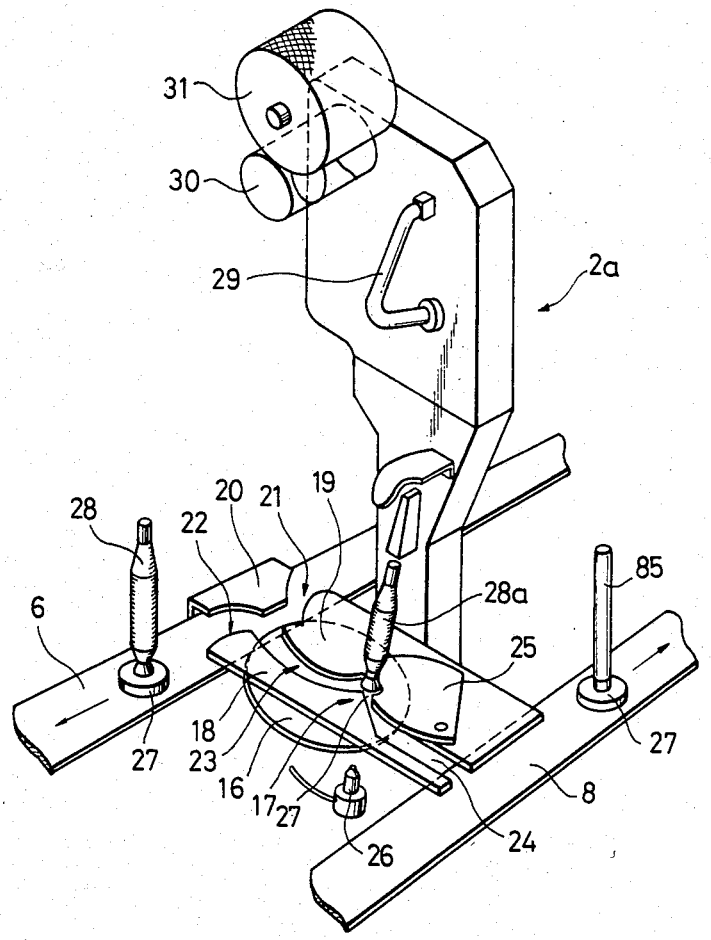
FIG. 3 is a schematic perspective view of a winding unit of the winder.

FIG. 3 shows an example of the winder which can be applied to the above-described system. The winder 2 is constituted by a plural number of juxtaposed winding units 2*a* to 2*n* which are located between the spinning bobbin transfer path 6 and the empty bobbin transfer path 8. The reference numeral 16 denotes a rotary disc which serves to transfer a spinning bobbin into a winding position 17 and to discharge an empty bobbin onto the path 8. Provided above the rotary disc 16 are guide plates 18 and 19 which are spaced from each other by a predetermined distance. A spinning bobbin entrance 21 and an exit 22 for excessive bobbins are formed between the guide plate 19 and another guide plate 20, while a spinning bobbin stand-by line 23 and a bobbin discharge line 24 are formed between the guide plates 18 and 19. The bobbin stand-by and discharge lines 23 and 24 are connected with each other at the aforementioned winding position 17. Denoted at 25 is a lever for discharging empty bobbin or a bobbin with residual yarn.

Provided beneath the winding position 17 is an air blow nozzle 26 connected to a conduit from a compressed air source which is not shown, the pressurized air from the nozzle 26 being blown into the take-up tube of the bobbin through an arcuate slit (not shown) which is formed in the rotary disc 16 and an internal cavity of the peg on the tray 27 to blow out an yarn end hanging down into the inner cavity of the take-up tube from the upper end thereof. The blown-up yarn end is caught by sucking action of a relay tube 29 which is located above the bobbin 28 and which is rotatable upward to introduce the yarn end into a knotter where the yarn end from the bobbin is knotted to a yarn end from a package prior to starting winding. Indicated at 30 is a traverse drum and at 31 is the winding package.

Thus, the knotting yarn end of a spinning bobbin which has been delivered along the transfer path 6 is picked up by the yarn end finder, sending the bobbin onto the transfer path 6 to the winder, with the yarn end inserted in the take-up tube of the spinning bobbin. The tray 27 is hit against guide plates 18 to 20 of the winding unit 2*a* as the bobbin 28 is conveyed along the transfer path 6, and caused to ride on the rotary disc 16 and advance through the spinning bobbin entrance 21 toward the winding position 17 along the stand-by line 23. In this manner, the succeeding spinning bobbins are sent into the stand-by line 23. As soon as the stand-by line 23 is filled with a predetermined number of spinning bobbins, the succeeding spinning bobbins which cannot enter the stand-by line 23 are sent to the excess bobbin exit 22 for transfer to a next winding unit.

Consequently, the winding units 2*a* to 2*n* are filled with the carriers carrying a spinning bobbin in the above-described fashion, from a winding unit which is located closer to the yarn end finder 7. If there are vacancies in the stand-by lines, they are filled from the winding unit 2*a* or a unit which is closer to the winding unit 2*a*.

Referring now to FIGS. 4 to 8, there is shown an embodiment of the bobbin transfer mechanism to be located between the spinning frame and winder for transfer of bobbins there-between.

Figure 4:
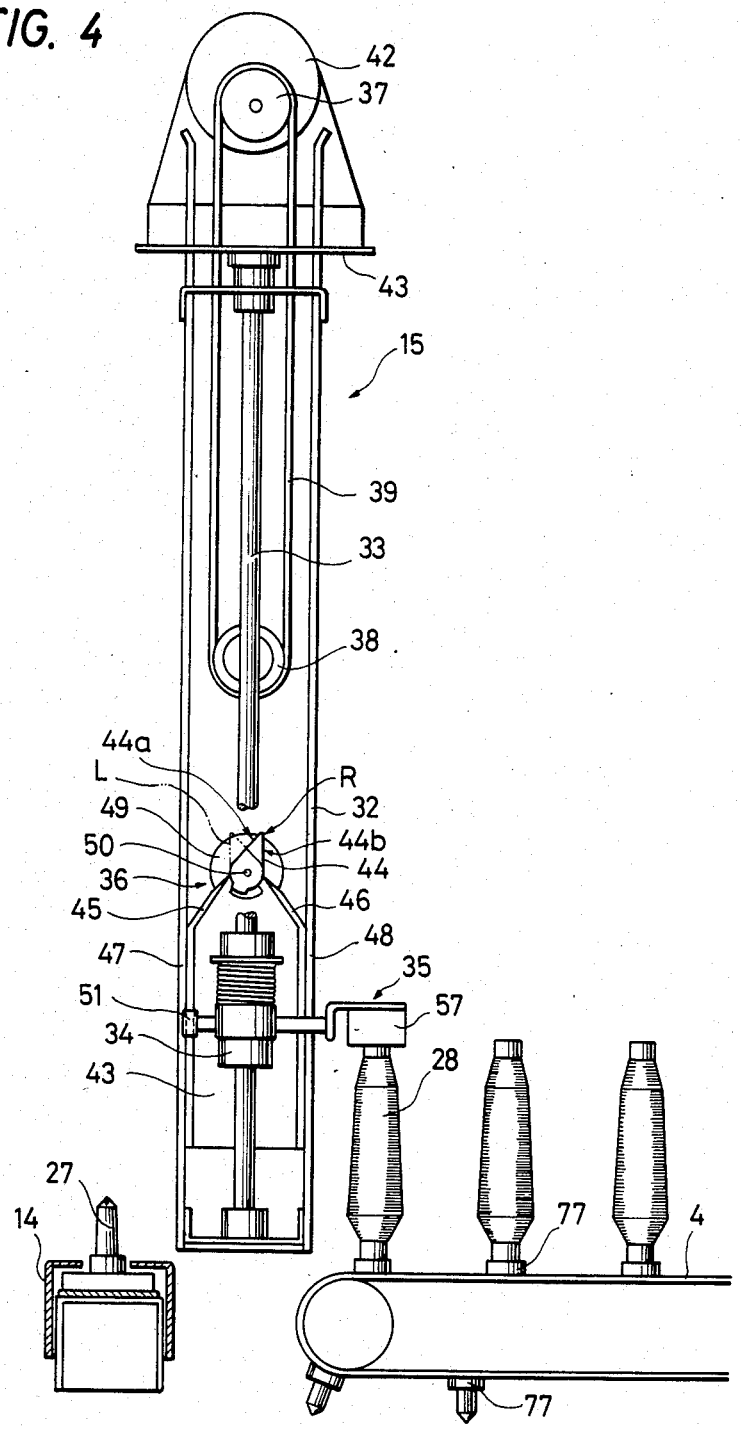
FIG. 4 is a front view of a bobbin transfer mechanism employed in the first embodiment.
Figure 5:
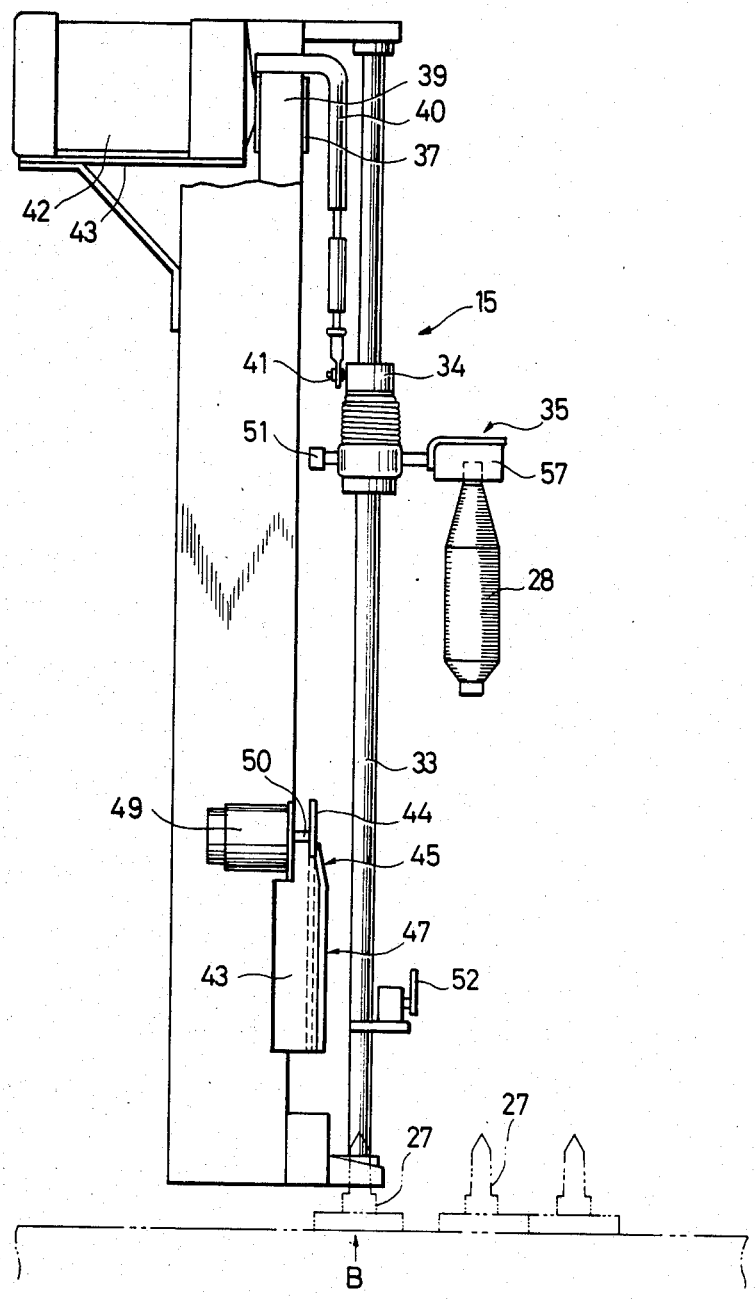
FIG. 5 is a side view of the same mechanism.

Shown in FIGS. 4 and 5 is the general construction of the bobbin transfer mechanism, including a lift member 34 slidably mounted on a guide shaft 33 erected at the center of a frame 32. The lift member 34 is provided with a bobbin chuck 35 which is rotatable about the shaft 33. Mounted in a lower portion of the frame 32 is a guide mechanism 36 for turning the bobbin chuck 35 between two different positions.

For moving the lift 34 up and down, an L-shaped rod 40 is fixed on a timing belt 39, which is passed around timing pulleys 37 and 38, and pivotally connected on part of the lift 34 as indicated at 41. The reference numeral 42 denotes a pulley drive motor which is mounted on a frame 43.

The guide mechanism 36 includes a fixed guide member 43 and a movable guide member 44. The fixed guide member 43 is formed in a sectionally arcuate semi-cylindrical shape, which is concentric with the shaft 33 and has upper corner portions cut off diagonally to provide inclined guide surfaces 45 and 46 and vertical guide surfaces 47 and 48. The movable guide member 44 is fixed to a rotary shaft 50 of a rotary solenoid 49 and rotated about the axis of the shaft 50 for movement between two different positions. When the movable guide member 44 is in the position R of FIG. 4, its guide surface 44*a* is disposed in continuation of the inclined guide surface 45, so that a cam follower 51 of the vertically movable chuck 35 is turned toward the guide surfaces 45 and 47 from a center position to move the chuck 35 in a direction away from the guide surface 47.

Figure 6:
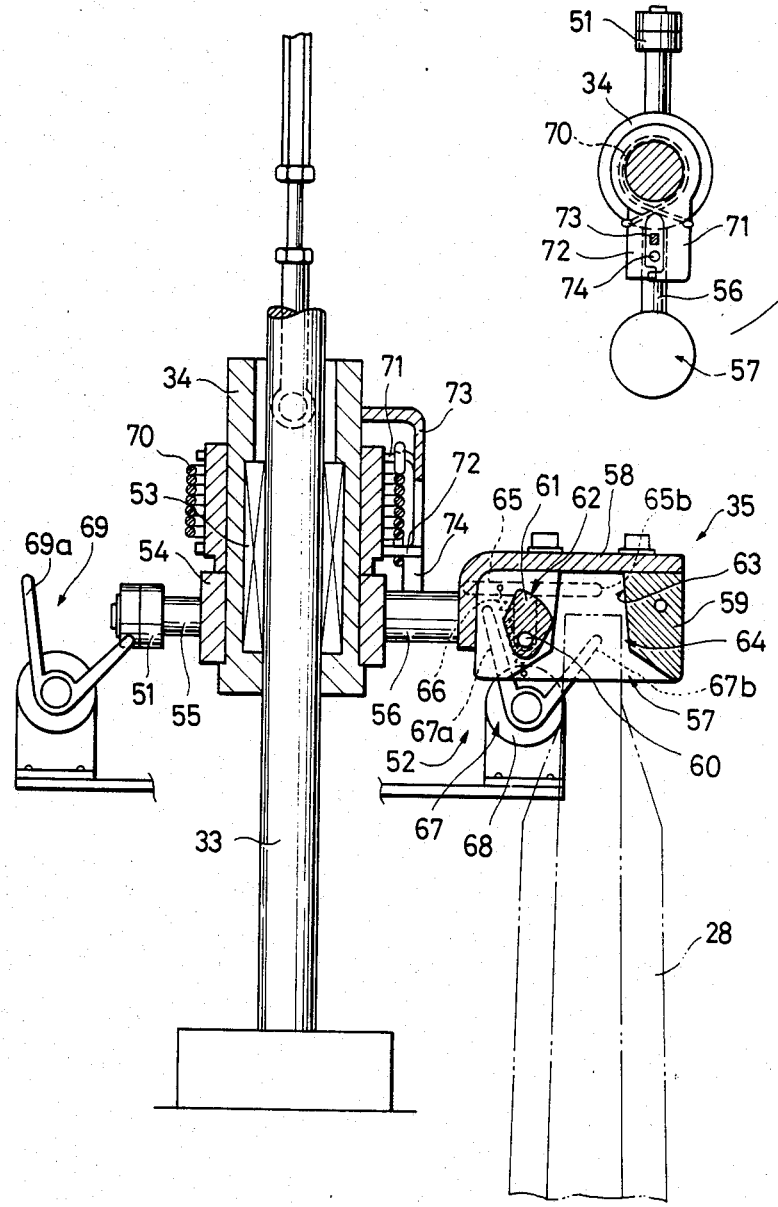
FIG. 6 is a sectioned side view of a chuck mechanism.

FIG. 6 illustrates the chuck 35 mounted on the lift 34 and a chucker opening and closing mechanism 52 which is mounted on a fixed frame. More specifically, a cylindrical member 54 is rotatably fitted on the circumference of the lift 34 which is supported on the guide shaft 33 through a thrust bearing 53. A pair of shafts 55 and 56 are fixedly secured to the cylindrical member 54 and projected therefrom in radially opposite directions. A cam follower 51 is rotatably supported on one shaft 55, and a chucker 57 is mounted on the other shaft 56 through a plate 58.

The chucker 57 includes a fixed chuck member 59 and a movable chuck member 61 which is fixed to a horizontal shaft 60, gripping the upper end of a take-up tube of a bobbin 28 between a curved surface 62 of the movable chuck member 61 and an inner surface 63 of the fixed chuck member 59. For this purpose, the inner surfaces of the chuck members 59 and 61 are shaped in arcuate surfaces with substantially the same radius as the circumference of the take-up tube.

Further, in a projected position relative to the chucker 57, a substantially T-shaped operating lever 65 is fixedly mounted on the shaft 60, and springs 66 are tensioned between the fixed chuck member 59 and lever 65 to determine the position of the movable chuck member 61 by snap action of the springs 66.

Denoted at 67 is a movable stopper to be abutted against the operating lever 65 for opening and closing the chuck member 61, the movable stopper 67 being fixedly mounted on the shaft of the rotary solenoid 68 and having bifurcated stopper arms 67*a* and 67*b*. The stopper 67 is operated by the rotary solenoid 68 into a position where one of the stopper arms 67a and 67b is abutted against the lever 65. In the state of FIG. 6, the stopper arm 67a is abutted against the left side of the lever 65, so that, if the chucker 57 is moved downward, the lever 65 is rotated clockwise about the shaft 60, causing the movable chuck member 61 on the shaft 60 to grip the bobbin 28. In the particular embodiment shown, the movable stopper 67 serves to transfer a spinning bobbin onto an empty carrier, and this can be attained simply by fixing the stopper arm 67a alone if desired.

The same applies to the other movable stopper 69. If the stopper arm 69a is fixed at a position where it is abutted against the lever 65b of the chucker 57 which grippingly holds a bobbin, the chuck member 61 will be opened by the stopper arm 69a.

Figure 7:
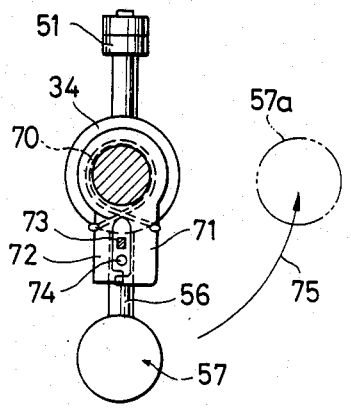
FIG. 7 is a plan view of the same chuck mechanism.

A torsion spring 70 is wound around the lift member 34 with the opposite ends of the spring 70 connected to chuck return levers 71 and 72 which are rotatable about the lift member 34 as shown in FIG. 7. The return levers 71 and 72 are abutted against an intermediate fixed stopper 73, and a fixed pin 74 is projected from the support shaft 56 of the chucker 57 at a position intermediate between the levers 71 and 72. Accordingly, if the chucker 57 is turned in the direction of an arrow 75 from the neutral position indicated by solid line into the position 57a indicated in phantom in FIG. 7, the pin 74 engages the lever 71 and turns the latter counterclockwise against the action of the spring 70. At this time, the other lever 72 is blocked against rotation by engagement with the stopper 73. Therefore, as soon as the cam follower 51 disengages from the guide body, the chucker 57 can return to the neutral position by the action of the spring 70. The lift member 34 is slidable relative to the shaft 33 but not rotatable.

The operation of the above-described bobbin transfer mechanism is as follows.

Figure 8:
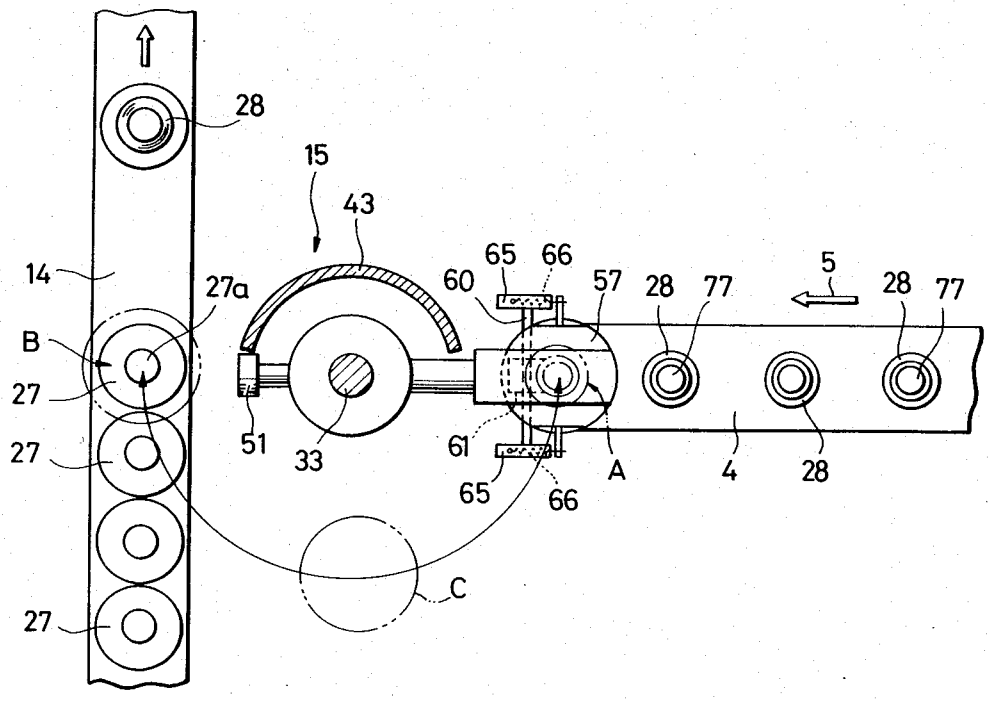
FIG. 8 is a plan view explanatory of the manner of transferring bobbins by the chuck mechanism.

Referring to FIG. 8, by the intermittent movement of the transport band 4 in the direction of arrow 5, the spinning bobbins 28 fitted on the pegs 77 on the transport band 4 are successively stopped at the spinning bobbin delivering position A under control of a bobbin detection means like a limit switch or the like.

On the other hand, empty bobbins or small amount of yarn bobbins are extracted from the winder in the manner as described hereinbefore, and the resulting empty carriers 27 are conveyed along the transfer path 14 constituted by a conveyer belt or the like, stopping the peg trays successively at the spinning bobbin receiving position B. In the event a bobbin with a windable yarn residue is delivered, it is detected by a sensor and advanced past the bobbin receiving position. Accordingly, it is convenient to provide at the spinning bobbin receiving position a tray sensor for detecting presence or absence of a tray, a sensor for discriminating a bobbin with a windable yarn residue and a sensor for confirming absence of an empty bobbin or small amount of yarn bobbins on a carrier.

Figure 11:
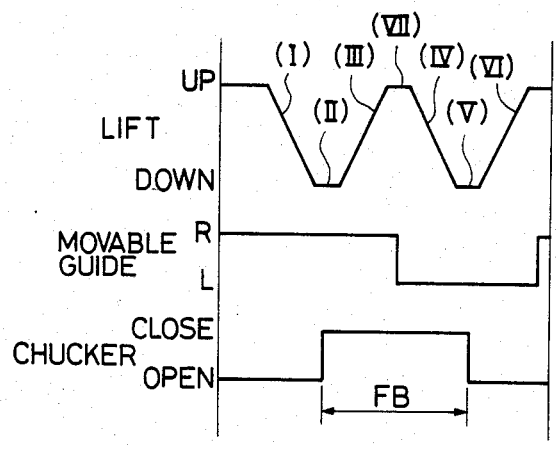
FIG. 11 is a timing chart in the first embodiment of the invention.

The distance between the spinning bobbin delivering position A and the bobbin receiving position B are located at the same distance from the pivotal center 33 of the chucker 57. As illustrated in FIG. 11, one cycle of the bobbin transfer operation consists of; a first stage (I) of lowering the chucker from the stand-by position; a second stage (II) of chucking a spinning bobbin on the transport band; a third stage (III) of lifting up the chucker which holds the spinning bobbin; a fourth stage (IV) of lowering the chucker with the spinning bobbin; a fifth stage (V) of fitting the spinning bobbin on an empty carrier; and a sixth stage (VI) of lifting up the empty chucker for return to the neutral position. The stages I to VI take place continuously during two vertical reciprocating motions of the lift member 34.

More particularly, when the lift member 34 is lowered from the upper stand-by position as shown in FIG. 4, the movable guide 44 is held in the position R indicated by solid line. Consequently, as the lift member is lowered, the cam follower 51 is guided along the side surface 44a of the movable guide 44 and then onto the vertical guide surface 47, so that the chucker 57 is turned about 90 degrees from the stand-by position C as shown in FIG. 8 and lowered on a spinning bobbin at the bobbin delivering position A until the upper end of the take-up tube of the bobbin is received in the chucker as shown particularly in FIGS. 4 and 6. Whereupon, the movable stopper arm 67a is abutted against the lever 65 and as a result the movable chuck member 61 is turned clockwise about the shaft 60 to grip the bobbin between the curved surface 62 and the fixed chuck member 59.

By a succeeding ascending motion of the lift member, the spinning bobbin is extracted from the peg 77 on the transport band 4 and, upon reaching the uppermost position or the upper dead center (VII), it is detected by a sensor or the like (not shown) and the movable guide 44 is switched to the reverse position L indicated in phantom in FIG. 4. As the lift member 34 is lowered in this state, the cam follower 51 is moved onto the vertical guide surface 48 from the side surface 44b of the movable guide 44, lifting down the chucker 57 toward the carrier 27 until the lift member 34 reaches the lower dead center (FIG. 11 (II)). Consequently, the spinning bobbin 28 is fitted on the peg 27a on the carrier 27, and the stopper arm 69a of FIG. 6 is abutted against the lever 65b of the chucker as a result of rotation of the latter, turning the movable chuck member 61 in a releasing direction and holding same in the open position by snap action of the springs 66. The lift member 34 is lifted again in this state to the upper dead center or the neutral position C, leaving the spinning bobbin on the carrier, thus completing one cycle of the bobbin transfer operation.

For intermittent movement of the transport band, it suffices to advance the band by one pitch during one cycle of operation of the chucker 57 after extraction of a spinning bobbin at the delivering position, for example, actuating a motor to move advance the transport band by one pitch when the chucker 57 gripping a spinning bobbin reaches the upper dead center (FIG. 11 (VII)), utilizing the signal which is produced to switch the position of the movable guide 44.

A carrier which has received a spinning bobbin at the spinning bobbin receiving position may be sent forward when reaching the upper dead center or stand-by position of the lift member after placing the spinning bobbin on the carrier, similarly in relation with the change-over of the movable guide 44 to the solid line position R of FIG. 4 which takes place upon a sensor detecting absence of a spinning bobbin at the stand-by position.

Figure 9:
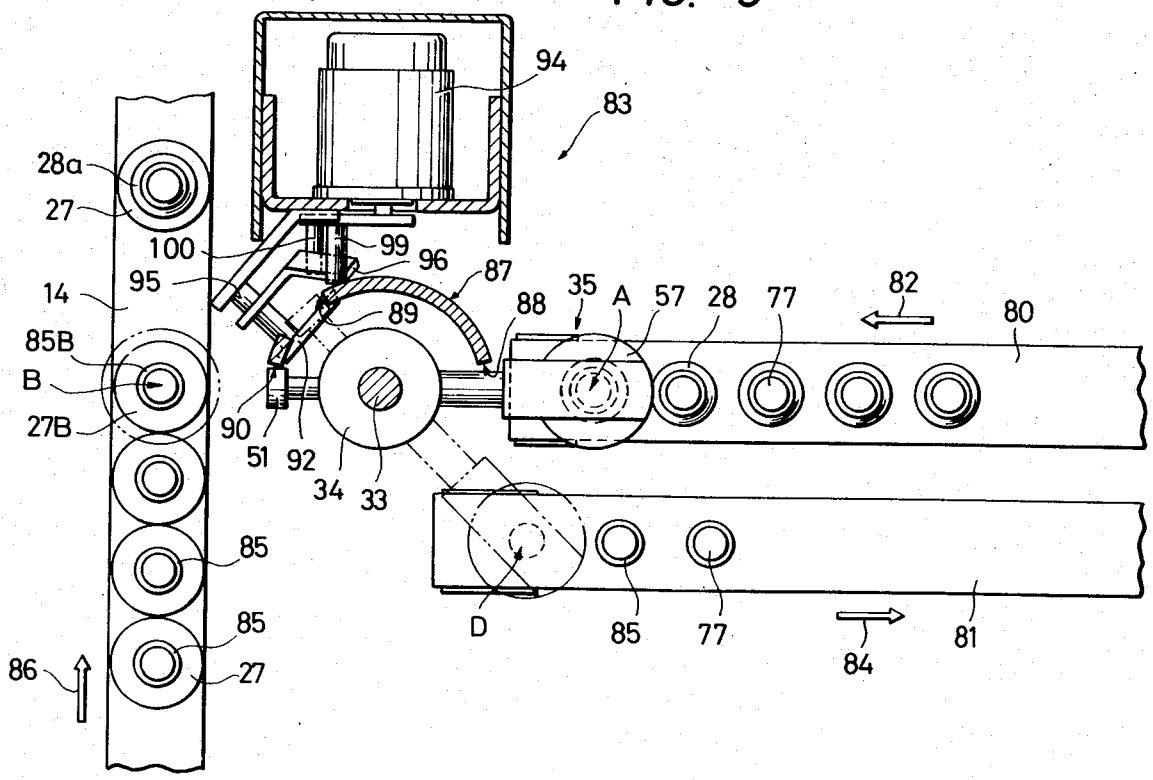
FIG. 9 is a plan view explanatory of the manner of transferring bobbins in a second embodiment of the present invention.

Referring now to FIG. 9, there is shown another embodiment of the bobbin transfer system, in which first and second transport bands 80 and 81 are provided in the longitudinal direction of the fine spinning frame in parallel relation with each other. The first transport band 80 is turned in the direction of an arrow 82 to convey toward the transfer mechanism 83 the spinning bobbins 28 which are produced on the fine spinning frame. On the other hand, the second transport band 81 is turned in the direction of an arrow 84 to receive the empty bobbins from the winder and convey same toward the fine spinning frame.

Further, on the winder side of the transfer mechanism 83, carriers 27 carrying empty bobbins 85 discharged from the winder are transferred on the conveyer 14 in the direction of an arrow 86. At a bobbin exchange position B, the empty bobbins on the carriers 27B are extracted and fresh spinning bobbins are placed thereon, sending carriers 27 with spinning bobbins **28*a*** to the winder through a yarn end finder.

The bobbin transfer mechanism 83 is the same as the transfer mechanism in the foregoing embodiment except that, since a chuck 35 assumes three different positions during its descending motion, a guide 87 is provided with first and second guide members in order to restrict the position of the chucker 57. Namely, in FIGS. 9 and 10, the guide 87 is provided with first to third stationary vertical guide surfaces 88 to 90 and first and second movable guide members 91 and 92. The first movable guide member 91 functions to steer the cam follower 51 toward either the first guide surface 88 or the second and third guide surfaces 89 and 90, and the second movable guide member 92 functions to steer the cam follower 51 toward either the second guide surface 89 or the third guide surface 90.

The first movable guide member 91 is positioned centrally on the upper end of the guide 93 and turned into one of two positions by a rotary solenoid 94. The second guide member 92 is positioned between the upper ends of the second and third guide surfaces 89 and 90 and provided integrally with a lever 96 which is rotatably supported on a stationary shaft 95. An end portion of the lever 96 is engaged between pins 99 and 100 on a lever 98 which is rockable between two positions by means of a rotary solenoid 97.

Accordingly, the first movable guide member 91 assumes the position L indicated by solid line when the chucker 57 of FIG. 9 is in the empty bobbin gripping position B. The first movable guide member 91 assumes the position R indicated in phantom and the second movable guide member 92 assumes the position indicated by solid line in FIG. 10 when the chucker is in the empty bobbin releasing position D. The first movable guide member 91 assumes the position R indicated in phantom in FIG. 10 and the second movable guide member assumes the position **92*a* indicated in phantom when the chucker is in the spinning bobbin gripping position A. The first movable guide member assumes the position L indicated by solid line in FIG. 10** when the chucker is in the spinning bobbin releasing position B.

Figure 12:
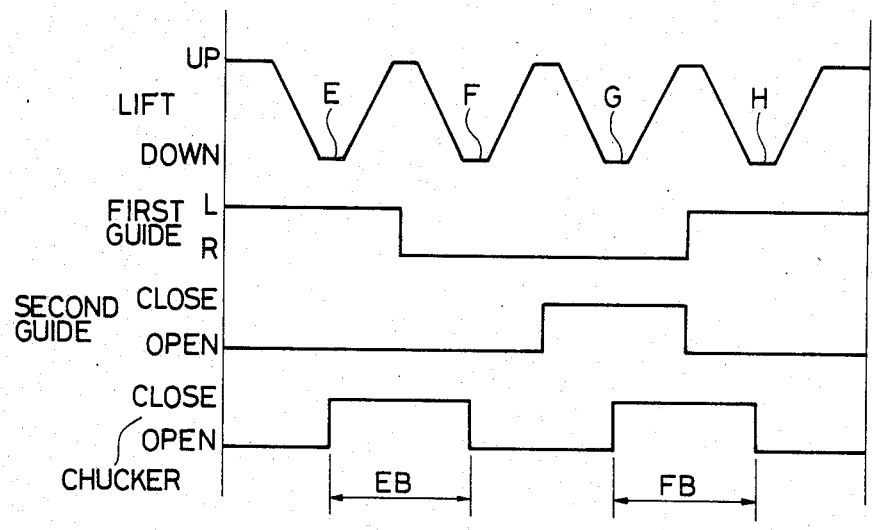
FIG. 12 is a timing chart in the second embodiment of the invention.

The first and second movable guide members 91 and 92 are operated in a predetermined timing, for example, switching their positions when the lift member 34 reaches the upper dead center, by detecting whether the chucker grips a spinning bobbin or an empty bobbin or whether the chucker grips no bobbin with use of a photoelectric sensor, a mechanical touch sensor or other suitable detection means. There are two different cases where no bobbin is gripped by the chucker when the lift member 34 is at the upper dead center, i.e., a phase of chucker stand-by immediately before commencement of one cycle of the bobbin transfer operation and a phase of chucker ascendance after transferring an empty bobbin from a carrier to the transport band 81. These cases can be discriminated by an AND logic using a sensor which is adapted to detect presence or absence of an empty bobbin on a carrier 28B at the bobbin receiving position B. Namely, when the lift member 34 is at the upper dead center, if a sensor at that position detects absence of an empty bobbin and a sensor at the position 27B detects presence of an empty bobbin on a carrier at that position, the chucker is in stand-by state and accordingly the first movable guide 91 is held in the position L indicated by solid line in FIG. 10. On the other hand, in a case where there is no bobbin on the chucker at the upper dead center and no empty bobbin on a carrier 27B at the position B, the chucker is considered to be in a phase of return subsequent to the transfer of an empty bobbin onto the second transport band 81, and the first and second movable guide members 91 and 92 are switched to the positions indicated in phantom in FIG. 10 in preparation for the next step of operation, that is to say, the step of gripping a spinning bobbin on the first transport band 80. In FIGS. 11 and 12, the reference characters FB and EB denote the phases of transferring a spinning bobbin and an empty bobbin, respectively.

For operating the movable chuck member at three different positions A, B and D, a movable stopper as shown at 67 of FIG. 6 is provided at the three positions A, B and D. The stopper at the position D of FIG. 9, where empty bobbins are simply released, is fixed at a predetermined position, and the stopper at the position A where spinning bobbin are simply chucked is also fixed at a predetermined position. On the other hand, the stopper at the position B, where empty bobbins are chucked and spinning bobbins are released, is switched into suitable positions. The position of the movable stopper is switched in a suitable timing by detection of presence or absence of an empty bobbin on a carrier 27B at the position B similarly to the first and second movable guide members 91 and 92.

One cycle of the bobbin transfer operation in the foregoing second embodiment is shown in the time chart of FIG. 12. As seen therefrom, during four reciprocal motions of the lift member, the chucker is suitably turned into predetermined positions by the guide body 93 of the first and second movable guide members 91 and 92, thereby transferring in upright state an empty bobbin 85 on a carrier from the winder onto the empty bobbin transport band on the side of the spinning frame while placing on the emptied carrier a spinning bobbin conveyed by the first transport band on the side of the spinning frame, sending back the spinning bobbin-loaded carrier to the winder. In FIG. 12, the lower dead center points E to H of the lift member are positions for empty bobbin chucking, empty bobbin releasing, spinning bobbin chucking and spinning bobbin releasing, respectively.

In the present embodiment, an empty bobbin and a spinning bobbin are exchanged at the bobbin delivering position, so that there is no necessity for providing the empty bobbin lift and transfer means 11, the chute 12 at the end of the fine spinning frame and the bobbin sorter 10 which are employed in the embodiment of FIG. 1.

Figure 10:
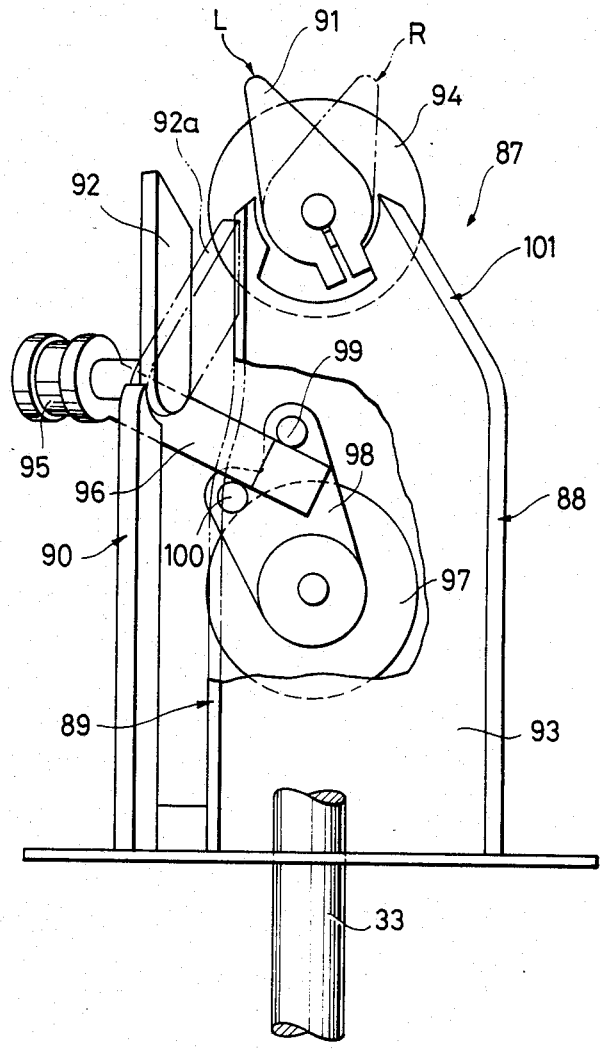
FIG. 10 is a front view of a guide for a chucker of the bobbin transfer mechanism in the same system.

Further, the guide 87 of FIG. 10 may be provided, on the other guide surface 101, with a third movable guide member similar to the second guide member 92 to form a fourth vertical guide surface, positioning the chucker at four different positions on the circle around the shaft 33 of FIG. 9 to transfer different kinds of spinning bobbins from a number of transfer paths on the side of the spinning frame onto carriers on a number of transfer paths which are provided on the side of the winder for each kind of bobbin. In such a case, different kinds of spinning bobbins can be transferred without confusion by providing a mark sensor or the like which is capable of discriminating the kinds of spinning bobbins.

Furthermore, although bobbins are transferred one by one in the foregoing embodiments, it is possible to provide a plural number of chuckers, for example, a couple of chuckers on the lift member in spaced positions corresponding to the bobbin pitch on the transport band, while providing stoppers which are adapted to position the carriers in the same pitch on the side of the winder to transfer a couple of bobbins simultaneously.

What is claimed is:

1. A bobbin transfer system for transferring a bobbin from a first peg to a second peg comprising:

a guide shaft, a lift member slidably mounted on said guide shaft, a bobbin chuck device supported on said lift member for gripping said bobbin at a yarn-free surface portion thereof, said bobbin chuck device being rotatable about said guide shaft from a position adjacent said first peg to a position adjacent said second peg, a guide mechanism for turning said bobbin chuck device between different positions, lift means for lifting said bobbin from said first peg, and lowering means for lowering said bobbin onto said second peg, wherein said bobbin chuck device comprises a cylindrical member rotatably fitted on said lift member, a pair of shafts secured to said cylindrical member and projected therefrom in radially opposite directions, a cam follower rotatably supported on one of said shafts, and a chucker mounted on the other of said shafts.

2. A bobbin transfer system as claimed in claim 1, wherein said bobbin includes a take-up tube and said chucker includes a horizontal shaft, a fixed chuck member, a movable chuck member which is pivotable about said horizontal shaft, said fixed chuck member and said movable chuck member acting to grip the upper end of said take-up tube of said bobbin therebetween.

3. A bobbin transfer system as claimed in claim 2, wherein said chucker further comprises a substantially T-shaped operating lever, a pair of springs tensioned between said fixed chuck member and said operating lever, a rotary solenoid having a shaft, and a movable stopper abutted against said operating lever, whereby movement of said stopper against said operating lever causes said moveable chuck member to pivot about said horizontal shaft, said movable stopper being fixedly mounted on said shaft of said rotary solenoid and having bifurcated stopper arms.

4. A bobbin transfer system for transferring a bobbin from a first peg to a second peg comprising:

a guide shaft, a lift member slidably mounted on said guide shaft, a bobbin chuck device supported on said lift member for gripping said bobbin at a yarn-free surface portion thereof, said bobbin chuck device being rotatable about said guide shaft from a position adjacent said first peg to a position adjacent said second peg, a guide mechanism for turning said bobbin chuck device between different positions, lift meanas for lifting said bobbin from said first peg, and lowering means for lowering said bobbin onto said second peg, wherein said guide mechanism includes at least one fixed guide member which is substantially concentric with said guide shaft, said fixed guide member having a first guide surface and a second guide surface, said guide mechanism further including at least one movable guide member having at least one guide face which may be aligned with either said first guide surface or said second guide surface of said fixed guide member, wherein said guide mechanism includes a first and second of said fixed guide members and a first and second of said movable guide members, said first movable guide member being positioned on the upper end of said first fixed guide member and said second movable guide member being positioned between the upper ends of said first and second fixed guide members.

5. A bobbin transfer system as claimed in claim 4, wherein said first movable guide member directs said bobbin chuck device toward either said first guide surface or said second guide surface of said first fixed guide member, and said second movable guide member directs said bobbin chuck device toward either said first guide surface or said second guide surface of said second fixed guide member, whereby said bobbin chuck device can be turned to three different positions.

* * * * *